US011831084B2

(12) United States Patent
Long et al.

(10) Patent No.: US 11,831,084 B2
(45) Date of Patent: Nov. 28, 2023

(54) DUAL-POLARIZED ANTENNA, ANTENNA ARRAY, AND COMMUNICATIONS DEVICE

(71) Applicant: Huawei Technologies Co., Ltd., Shenzhen (CN)

(72) Inventors: Ke Long, Chengdu (CN); Chuan Liu, Chengdu (CN); Biao Feng, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 286 days.

(21) Appl. No.: 17/244,584

(22) Filed: Apr. 29, 2021

(65) Prior Publication Data

US 2021/0249789 A1 Aug. 12, 2021

Related U.S. Application Data

(63) Continuation of application No. PCT/CN2019/114418, filed on Oct. 30, 2019.

(30) Foreign Application Priority Data

Oct. 31, 2018 (CN) ..... 201811287654.1

(51) Int. Cl.
*H01Q 21/06* (2006.01)
*H01Q 21/24* (2006.01)
*H01Q 21/00* (2006.01)

(52) U.S. Cl.
CPC ..... *H01Q 21/24* (2013.01); *H01Q 21/0006* (2013.01); *H01Q 21/065* (2013.01)

(58) Field of Classification Search
CPC .. H01Q 21/24; H01Q 21/0006; H01Q 21/065; H01Q 9/0414
See application file for complete search history.

(56) References Cited

U.S. PATENT DOCUMENTS

2015/0214629 A1 7/2015 Hagiwara et al.
2017/0085002 A1 3/2017 Huang et al.

FOREIGN PATENT DOCUMENTS

CN 201191649 Y 2/2009
CN 102110910 A 6/2011
(Continued)

OTHER PUBLICATIONS

Chen et al., "Dual-polarized Multi-layer Microstrip Array Antenna with H-shaped Coupling Slot," 2012 International Conference on Microwave and Millimeter Wave Technology (ICMMT), total 3 pages, Institute of Electrical and Electronics Engineers, New York, New York (May 5-8, 2012).
(Continued)

*Primary Examiner* — Dieu Hien T Duong
(74) *Attorney, Agent, or Firm* — Leydig, Voit & Mayer, Ltd.

(57) ABSTRACT

A dual-polarized antenna, an antenna array, and a communications device are disclosed. The dual-polarized antenna includes a base board, a horizontally polarized antenna, and a vertically polarized antenna. The substrate includes a first substrate and a plurality of second substrates stacked on the first substrate. The horizontally polarized antenna includes a first radiating element disposed on the first substrate, and a first feeding unit that feeds the first radiating element. The vertically polarized unit includes a second radiating element and a second feeding unit that feeds the second radiating element. The second radiating element includes a first metal patch disposed on each second substrate. In the foregoing technical solution, the base board formed by the stacked substrates is used as a support part, so that the horizontally polarized antenna and the vertically polarized antenna are disposed on the base board, thereby reducing space occupied by the dual-polarized antenna.

11 Claims, 11 Drawing Sheets

(56) References Cited

FOREIGN PATENT DOCUMENTS

| | | | |
|---|---|---|---|
| CN | 102148428 | A | 8/2011 |
| CN | 102280718 | A | 12/2011 |
| CN | 102842755 | A | 12/2012 |
| CN | 102447163 | B | 8/2013 |
| CN | 103887595 | A | 6/2014 |
| CN | 104577316 | A | 4/2015 |
| CN | 105609944 | A | 5/2016 |
| CN | 105789913 | A | 7/2016 |
| CN | 106410366 | A | 2/2017 |
| CN | 106711595 | A | 5/2017 |
| CN | 106816698 | A | 6/2017 |
| CN | 106887722 | A | 6/2017 |
| CN | 107342458 | A | 11/2017 |
| CN | 108429009 | A | 8/2018 |
| CN | 108598690 | A | 9/2018 |
| CN | 208028210 | U | 10/2018 |
| EP | 0671779 | A1 | 9/1995 |
| KR | 20110035722 | A | 4/2011 |
| KR | 1164618 | B1 * | 7/2012 |

OTHER PUBLICATIONS

Yetisir et al., "Wideband Dual-Polarized Omnidirectional Antenna with very High Isolation across 1.65-2.7 GHZ," 2014 IEEE Antennas and Propagation Society International Symposium (APSURSI), AP-S2014, pp. 1123-1124, Institute of Electrical and Electronics Engineers, New York, New York (Jul. 6-11, 2014).

Wang et al., "Wideband Omnidirectional Planar Antenna with Vertical Polarization," 2017 11th European Conference on Antennas and Propagation (EUCAP), pp. 3865-3868, Institute of Electrical and Electronics Engineers, New York, New York (Mar. 19-24, 2017).

Chiou et al., "Broad-Band Dual-Polarized Single Microstrip Patch Antenna With High Isolation and Low Cross Polarization," IEEE Transactions on Antennas and Propagation, vol. 50, No. 3, pp. 399-401, Institute of Electrical and Electronics Engineers, New York, New York (Mar. 2002).

Shafai et al., "Dual-Band Dual-Polarized Perforated Microstrip Antennas for SAR Applications," IEEE Transactions on Antennas and Propagation, vol. 48, No. 1, pp. 58-66, Institute of Electrical and Electronics Engineers, New York, New York (Jan. 2000).

Sun et al., "C-Band Dual-Polarized Stacked-Patch Antenna with Low Cross-Polarization and High Isolation," 3rd European Conference on Antennas and Propagation, pp. 2994-2997, Institute of Electrical and Electronics Engineers, New York, New York (Mar. 2009).

* cited by examiner

DUAL-POLARIZED ANTENNA, ANTENNA ARRAY, AND COMMUNICATIONS DEVICE

CROSS-REFERENCE TO RELATED APPLICATIONS

This application is a continuation of International Application No. PCT/CN2019/114418, filed on Oct. 30, 2019, which claims priority to Chinese Patent Application No. 201811287654.1, filed on Oct. 31, 2018. The disclosures of the aforementioned applications are hereby incorporated by reference in their entireties.

TECHNICAL FIELD

This application relates to the field of communications technologies, and in particular, to a dual-polarized antenna, an antenna array, and a communications device.

BACKGROUND

As mobile communications technologies continuously develop, from 2G to 3G, 4G, and then to upcoming 5G, people have increasingly high requirements on a communication speed. 5G has an advantage of a fast transmission speed. However, since frequencies in a high frequency band of 5G reach 28 GHz, requirements on antennas are correspondingly increased.

Currently, ceiling antennas applied to indoor micro base stations need to have a horizontally omnidirectional radiation characteristic, to achieve even coverage of indoor signals. In addition, the antennas need to radiate both horizontally polarized waves and vertically polarized waves, to implement polarization diversity. Since a millimeter wave band antenna has a small size, it is difficult to assemble a vertical radiation structure due to a process limitation. Therefore, the antenna needs to be implemented by using a multi-layer PCB process. In addition, because a path loss of a millimeter wave band electromagnetic wave is relatively large, arraying is required to achieve a high gain. Therefore, a miniaturization requirement is imposed on an elementary antenna.

Currently, omnidirectional dual-polarized antennas are commonly applied to indoor micro base stations. Metal monopoles or biconical antennas, or the like are generally used for vertical polarization of the omnidirectional dual-polarized antennas, and ring antennas are generally used for horizontal polarization. Omnidirectional dual-polarized radiation is implemented by combining the two types of antennas. However, a dual-polarized antenna in conventional technologies has a relatively large size and occupies relatively large space.

SUMMARY

Embodiments of this application provide a dual-polarized antenna, an antenna array, and a communications device, to reduce space occupied by the dual-polarized antenna.

According to a first aspect, a dual-polarized antenna is provided. The dual-polarized antenna includes a base board, and the base board is used as a carrier on which a horizontally polarized antenna and a vertically polarized antenna are disposed. During specific disposing, the base board includes a plurality of structures that are stacked, and specifically includes one first substrate and a plurality of second substrates stacked on the first substrate. The horizontally polarized antenna is disposed on the first substrate, and the vertically polarized antenna is disposed on the plurality of second substrates. When the horizontally polarized antenna is disposed, the horizontally polarized antenna includes a first radiating element disposed on the first substrate and a first feeding unit that feeds the first radiating element. The vertically polarized antenna includes a second radiating element and a second feeding unit that feeds the second radiating element. The second radiating element is formed by a multi-layer structure. The multi-layer structure includes a first metal patch disposed on each second substrate, and a plurality of second metal patches. The plurality of second metal patches are stacked to form the second radiating element of the vertically polarized antenna. In the foregoing technical solution, the base board formed by the stacked substrates is used as a support part, so that the horizontally polarized antenna and the vertically polarized antenna are disposed on the base board, thereby reducing space occupied by the dual-polarized antenna.

When the horizontally polarized antenna is specifically disposed, the first radiating element includes a metal layer disposed on a surface of the first substrate, and a plurality of slots that are provided on the metal layer and arranged annularly. There may be different quantities of slots, for example, four slots, six slots, or eight slots. Correspondingly, the first feeding unit includes a first feeding line and a power splitter network connected to the first feeding line, and the power splitter network is in coupling connection to each slot.

In addition, when there are four slots, the power splitter network is further connected to a microstrip having a phase shift function. A length of the microstrip is half of a medium wavelength corresponding to an operating frequency, so that a feeding phase difference between adjacent slots is 180°.

When the first radiating element and the first feeding unit are disposed on the first substrate, the first radiating element is disposed on a surface that is of the first substrate and that faces the second substrate; and the first feeding line is disposed on a surface that is of the first substrate and that is away from the second substrate.

The dual-polarized antenna further includes a third substrate, where the third substrate and the first substrate are separately arranged on two sides of the plurality of second substrates; a plurality of second metal patches arranged in an array are disposed on a surface that is of the third substrate and that is away from the second substrate; and the second metal patches are in coupling connection to the first radiating antenna. A bandwidth of the horizontally polarized antenna is increased by disposing the second metal patches.

When the vertically polarized antenna is disposed, the second feeding unit includes a second feeding line disposed on a surface that is of the first substrate and that is away from the second substrate, and a metalized via that penetrates the first substrate and the plurality of second substrates; and the metalized via is electrically connected to the second feeding line, and the metalized via is in coupling connection to the plurality of first metal patches. The second feeding line and the first feeding line are disposed on a same side of the first substrate.

To improve performance of the vertically polarized antenna, on at least one of the plurality of second substrates, a metal ring sleeved on the first metal patch on the second substrate is disposed; and the metal ring is in coupling connection to the first metal patch corresponding to the metal ring, to improve low-frequency matching.

In a specific implementation solution, there are two metal rings, and the two metal rings are separately disposed on second substrates that are located at two ends of the plurality of stacked second substrates. Certainly, the metal ring may alternatively be disposed on another second substrate.

During specific feeding, the metalized via and the first metal patch are coaxially disposed.

When the second metal patches are specifically disposed, the plurality of first metal patches are coaxially disposed. In addition, sizes of the first metal patches may be the same or may be different. During specific disposing, the first metal patches on the plurality of second substrates have different sizes, and new resonance points are introduced through coaxial disposing to expand a bandwidth of the vertically polarized antenna.

The first metal patch may have different shapes. For example, the first metal patch is circular, polygonal, or cross-shaped. Certainly, the first metal patch may alternatively be in another shape.

According to a second aspect, an antenna array is provided. The antenna array includes the dual-polarized antenna according to any one of the foregoing implementation solutions. A base board formed by stacked substrates is used as a support part, so that a horizontally polarized antenna and a vertically polarized antenna are disposed on the base board, thereby reducing space occupied by the dual-polarized antenna.

According to a third aspect, a communications device is provided. The communications device includes the dual-polarized antenna according to any one of the foregoing implementation solutions or the foregoing antenna array. A base board formed by stacked substrates is used as a support part, so that a horizontally polarized antenna and a vertically polarized antenna are disposed on the base board, thereby reducing space occupied by the dual-polarized antenna.

DESCRIPTION OF EMBODIMENTS

To make objectives, technical solutions, and advantages of this application clearer, the following further describes this application in detail with reference to the accompanying drawings.

To facilitate understanding of a dual-polarized antenna provided in embodiments of this application, an application scenario of the dual-polarized antenna is first described. The dual-polarized antenna provided in the embodiments of this application is applied to an indoor micro base station. Therefore, the dual-polarized antenna needs to have a relatively small size. To achieve this effect, an embodiment of this application provides a dual-polarized antenna.

The dual-polarized antenna provided in this embodiment of this application includes two parts: a horizontally polarized antenna and a vertically polarized antenna. When the two types of antennas are specifically disposed, the two types of antennas are supported by using a disposed base board 10. When the foregoing antennas are specifically manufactured, the base board 10 may be a PCB board, and structures of the foregoing antennas may be directly printed on the base board 10. Certainly, the foregoing antennas may alternatively be formed by using another board material and another manufacturing process. For example, the structures of the antennas are formed on the base board 10 through bonding or in another manner.

Figure 1:
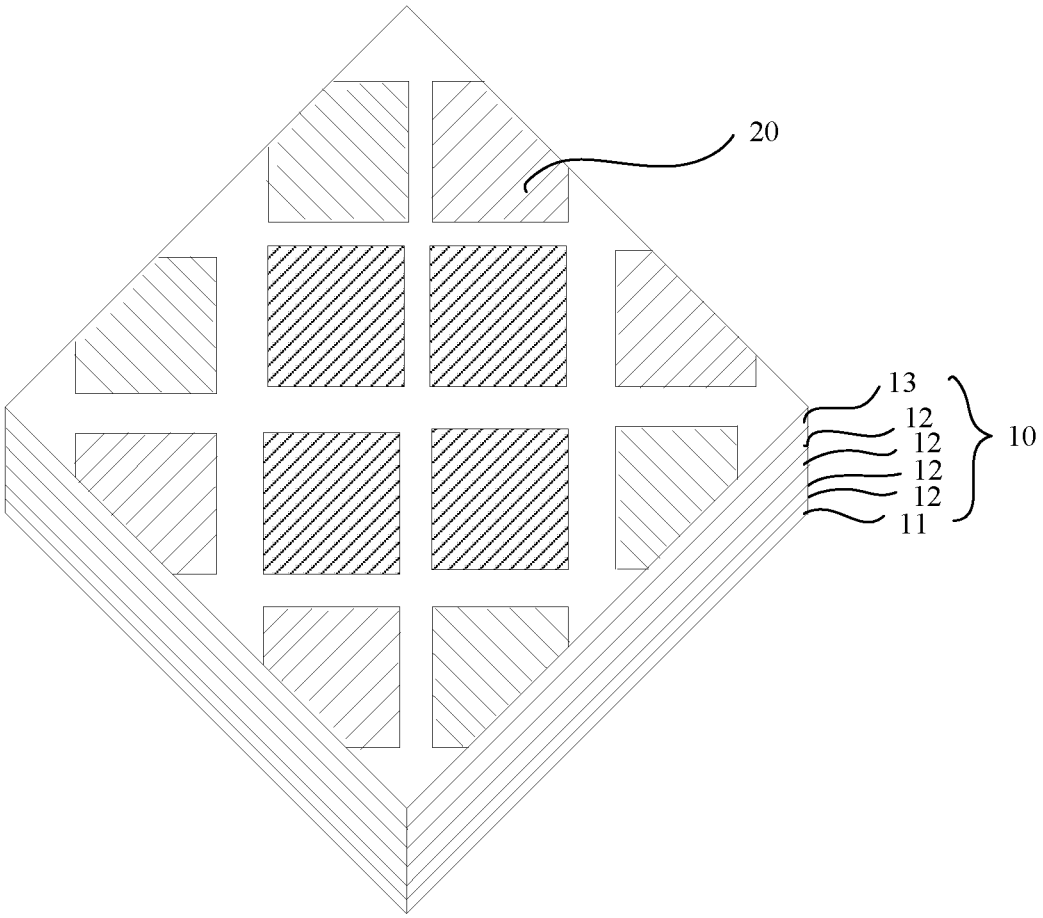
FIG. 1 is a schematic structural diagram of a dual-polarized antenna according to an embodiment of this application.
Figure 2:
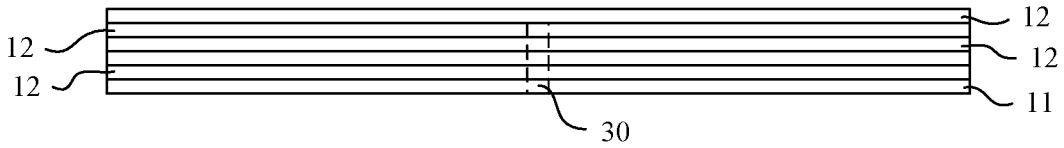
FIG. 2 is a side view of a dual-polarized antenna according to an embodiment of this application.

A structure that carries the antenna includes a multi-layer structure. As shown in FIG. 1 and FIG. 2, for ease of description, the multi-layer structure of the base board 10 is named and divided. The multi-layer structure includes a first substrate 11 and second substrates 12. The first substrate 11 has one layer, the second substrates 12 have a plurality of layers, and the first substrate 11 and the plurality of layers of second substrates 12 are stacked to form the base board 10. A placement direction of a dual-polarized antenna shown in FIG. 2 is used as a reference direction. The first substrate 11 is located at a bottom layer, and the plurality of layers of second substrates 12 are located on the first substrate 11 and are sequentially arranged upward in a vertical direction. When the horizontally polarized antenna and the vertically polarized antenna are carried, the first substrate 11 carries a main structure of the horizontally polarized antenna, and the second substrates 12 carry a main structure of the vertically polarized antenna. A manner of disposing the horizontally polarized antenna and the vertically polarized antenna on the base board 10 is described in detail below with reference to the accompanying drawings.

Figure 3:
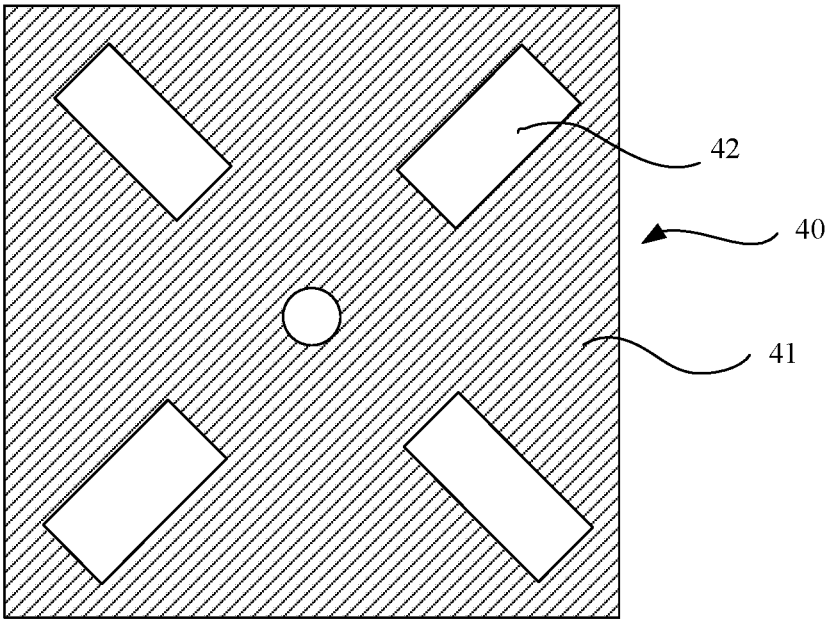
FIG. 3 is a schematic structural diagram of a first radiating element according to an embodiment of this application.

Referring to FIG. 2 and FIG. 3 together, FIG. 3 shows a structure of a first radiating element 40 of the horizontally polarized antenna. In this embodiment of this application, the horizontally polarized antenna mainly includes two parts: the first radiating element 40 and a first feeding unit 50. Functionally, the first radiating element 40 is configured to transmit a signal, and the first feeding unit 50 is configured to feed the signal to the first radiating element 40. When the first radiating element 40 and the first feeding unit 50 are specifically disposed, referring to FIG. 3 and FIG. 4, the first radiating element is disposed on one surface of the first substrate 11, and the first feeding unit 50 is disposed on the other opposite surface of the first substrate 11. The surface on which the first radiating element 40 is disposed faces a surface of the second substrate 12. A surface on which a first feeding line is disposed is away from the surface of the second substrate 12.

The first radiating element 40 radiates through a slot 42. Specifically, the first radiating element 40 includes a metal layer 41 disposed on a surface of the first substrate 11, and a plurality of slots 42 that are provided on the metal layer 41. When the slots 42 are specifically provided, as shown in FIG. 3, four slots 42 are provided, and the four slots 42 are arranged annularly. However, it should be understood that a quantity of slots 42 disclosed in FIG. 3 is merely an example. Alternatively, there may be other different quantities of slots 42, for example, six slots, eight slots, or ten slots 42. In addition, a diameter of an annular ring arranged by using the plurality of slots 42 may also be set as required, and is not limited to a specific diameter size shown in FIG. 3. In addition, when the slots 42 are specifically provided, the slots 42 are all rectangular and long-strip-shaped. Certainly, the slot 42*s* in another form may alternatively be used, for example, slot 42*s* in a bending structure, and more specifically, for example, slot 42*s* in an L shape or another shape.

When feeding is implemented, the first feeding unit 50 feeds the first radiating element 40. When the first feeding unit 50 is specifically disposed, the first feeding unit 50 includes the first feeding line and a power splitter network. The power splitter network is provided based on a specific quantity of slots 42. For example, when there are four slots, two level-2 power splitters are correspondingly provided, and signals of the first feeding line are separately transmitted to the four slots 42. If six or eight slots are used, the power splitter network is correspondingly provided to ensure that feeding can be implemented through each slot 42. In addition, when the first feeding unit 50 is specifically disposed, the first feeding unit 50 is located on another surface that is on the first substrate 11 and that is opposite to the first radiating element 40. In addition, the power splitter network performs feeding in a coupling manner. The coupling feeding manner may include direct coupling and indirect coupling. During the direct coupling, a power splitter is directly connected to a metal side wall of the slot 42. During the indirect coupling, a capacitor structure is formed by using a side wall of the slot 42 and a power splitter, to implement coupling feeding. Specifically, when there are four slots 42 shown in FIG. 4, the power splitter network is further connected to a microstrip 51 having a phase shift function. A length of the microstrip 51 is half of a medium wavelength corresponding to an operating frequency, so that a feeding phase difference between adjacent slots 42 is 180°. Specifically, two phase shifters are disposed, and the phase shifters are disposed at an interval, so that feeding directions of two adjacent slots 42 are opposite. In this case, to ensure that feeding phases of the slots 42 are consistent to form an annular displacement current, during specific implementation, a section of 180° phase shift line is disposed. It should be understood that when there are a plurality of slots 42, for example, when there are different quantities of slots such as six slots or eight slots, corresponding manners may also be used for disposing. However, a corresponding phase shift angle needs to be determined according to an actual situation, provided that an annular displacement current is formed.

Figure 7:
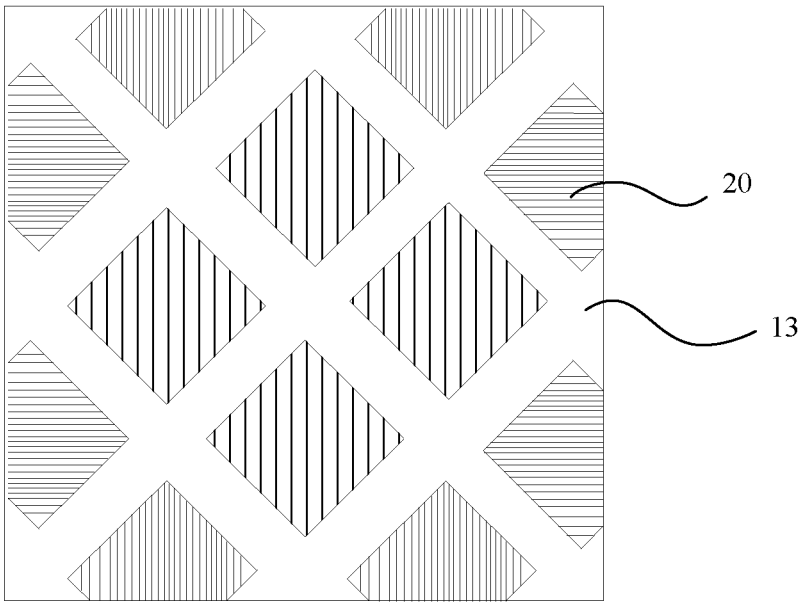
FIG. 7 is a schematic structural diagram of a third metal patch according to an embodiment of this application.

When the horizontally polarized antenna is disposed, to improve a bandwidth of the horizontally polarized antenna, second metal patches 20 arranged in an array may be further disposed. The second metal patches 20 are in coupling connection to the first radiating element 40, and are specifically coupled to the first radiating element 40 through the slots 42 described above. During disposing, the second metal patches 20 and the first radiating element 40 are disposed at an interval, and a third substrate 13 is disposed on the base board 10 to support the second metal patches 20. For details, refer to FIG. 1. It can be learned from FIG. 1 that the third substrate 13, the first substrate 11, and the second substrate 12 are stacked, and the third substrate 13 and the first substrate 11 are separately arranged on two sides of the plurality of second substrates 12. Using the placement direction of the dual-polarized antenna shown in FIG. 1 as an example, the third substrate 13 is located on the topmost second substrate 12. When the second metal patches 20 are disposed, the second metal patches 20 are disposed on a surface that is of the third substrate 13 and that is away from the second substrate 12. In addition, the second metal patches 20 are arranged in an array, and adjacent second metal patches 20 are disposed at an interval. During specific array arrangement, an arrangement direction of the second metal patches 20 may be parallel to an edge of the third substrate 13, or may be inclined at a specific angle. In the structures shown in FIG. 1 and FIG. 7, an angle between the arrangement direction of the second metal patches 20 and an arrangement direction of the third substrate 13 is 45°. It should be understood that the foregoing angle is merely an example, and the second metal patches 20 may alternatively be arranged in another arrangement direction. In addition, a shape of the second metal patch 20 is not limited to the rectangle shown in FIG. 1, and another shape may also be used, provided that a bandwidth of the horizontally polarized antenna can be increased.

Figure 5:
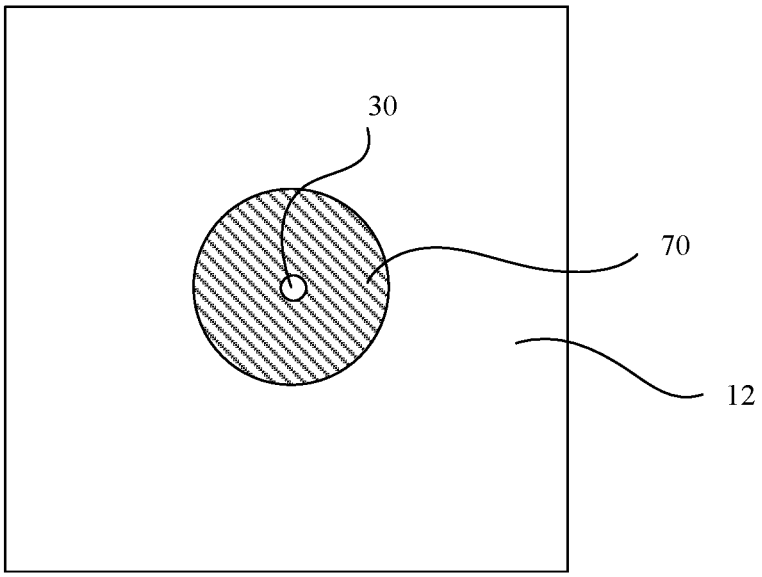
FIG. 5 is a schematic structural diagram of a second radiating element according to an embodiment of this application.

For the vertically polarized antenna, the vertically polarized antenna includes a second radiating element and a second feeding unit 60. The second radiating element includes a plurality of first metal patches 70. FIG. 5 shows a structural form of one first metal patch 70. Using the placement direction of the dual-polarized antenna shown in FIG. 1 as a reference direction, the plurality of first metal patches 70 are arranged along a vertical direction. In addition, when the plurality of first metal patches 70 are specifically disposed, each first metal patch 70 is in a one-to-one correspondence with the second substrate 12, that is, each first metal patch 70 is fastened to one surface of one second substrate 12. In addition, when the first metal patch 70 is disposed, adjacent first metal patches 70 are disposed at an interval, that is, the first metal patch 70 is disposed on a surface of the second substrate 12. In addition, when the first radiating element 40 and the second radiating element are specifically disposed, the metal layer 41 of the first radiating element 40 and the first metal patch 70 of the second radiating element are disposed at an interval. This is reflected in a specific disposing manner in which the metal layer 41 and the first metal patch 70 are disposed on an upper surface of the first substrate 11 and an upper surface of the second substrate 12, respectively.

Figure 12:
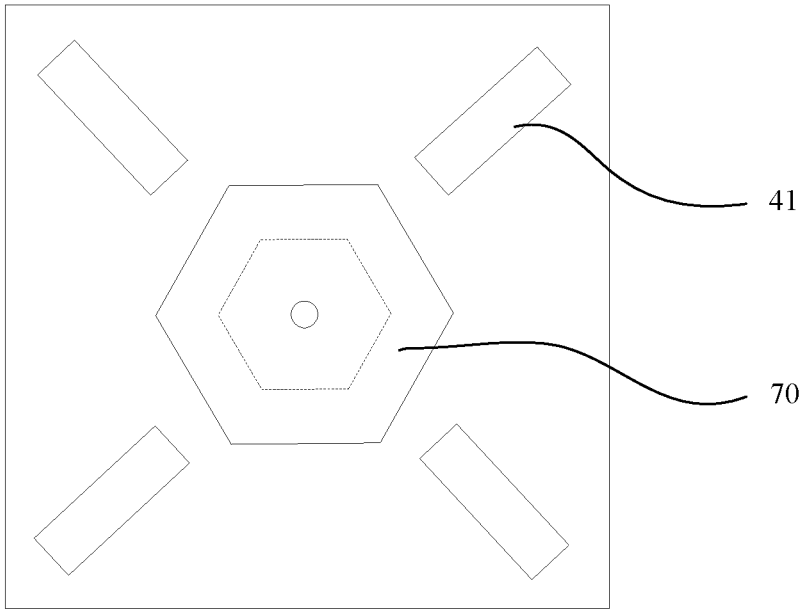
FIG. 12 is a schematic structural diagram of another dual-polarized antenna according to an embodiment of this application.
Figure 13:
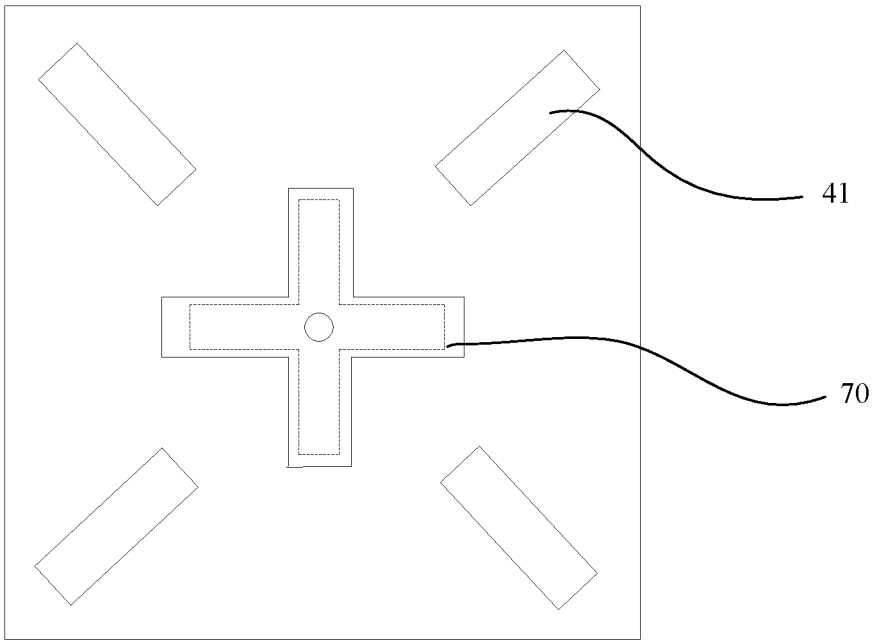
FIG. 13 is a schematic structural diagram of another dual-polarized antenna according to an embodiment of this application.

The first metal patch 70 may have different shapes. For example, the first metal patch 70 is circular, polygonal, or cross-shaped. As shown in FIG. 5, the first metal patch 70 is circular. However, as shown in FIG. 12, the first metal patch 70 is hexagonal. As shown in FIG. 13, the first metal patch 70 is cross-shaped. Certainly, the first metal patch 70 is not limited to being in the foregoing specific shapes, and may alternatively be in another shape. However, it should be noted that, when the shape of the first metal patch 70 is determined, shapes of all the plurality of first metal patches 70 are the same, for example, all are circular or all are square. Sizes of the first metal patches 70 at different layers may be the same, or may be different. For example, the sizes of the first metal patches 70 gradually decrease along a vertical direction from top to bottom. In addition, during specific stacking, the plurality of first metal patches 70 may be coaxially disposed, or disposed in a manner in which there is a particular deviation between the plurality of first metal patches 70. In a specific implementation solution, the first metal patches 70 on the plurality of second substrates 12 have different sizes, and new resonance points are introduced through coaxial disposing to extend a bandwidth of the vertically polarized antenna.

When the plurality of first metal patches 70 are specifically disposed, the plurality of first metal patches 70 are disposed at an interval, but a distance of the interval should ensure that the plurality of first metal patches 70 form a radiator whose polarization direction is a vertical direction. In this embodiment of this application, the second substrate 12 is a PCB board, and has a limited thickness. Therefore, although the plurality of first metal patches 70 are disposed at an interval, the plurality of first metal patches 70 may still be equivalent to a radiator whose polarization direction is the vertical direction.

For a relative position relationship between the first metal patch 70 and the slot 42, as shown in FIG. 12 and FIG. 13, vertical projections of the first metal patch 70 and the slot 42 in a horizontal plane may overlap each other, or may be spaced from each other. This is not limited herein, provided that when the slot 42 and the first metal patch 70 are specifically disposed, the two are electrically isolated from each other. Spatial positions of the two may not be limited. Therefore, the two may be disposed in a manner in which the vertical projections of the two overlap in the horizontal plane. In this way, a spatial area occupied by the horizontally polarized antenna can be reduced in the horizontal direction.

Figure 6:
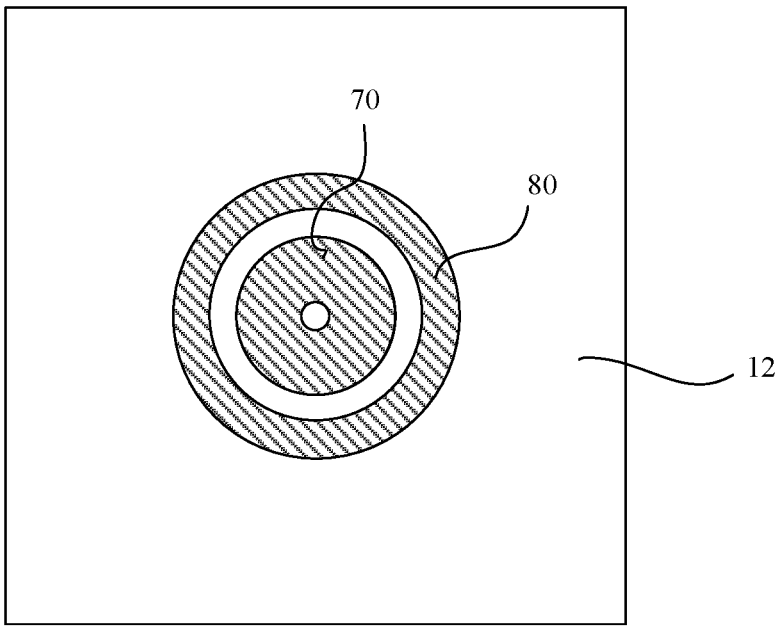
FIG. 6 is another schematic structural diagram of a second radiating element according to an embodiment of this application.

In addition, to improve performance of the vertically polarized antenna, as shown in FIG. 6, the second radiating element further includes a metal ring 80 surrounding the first metal patch 70. When the metal ring 80 is specifically disposed, a shape of the metal ring 80 matches the shape of the first metal patch 70. That is, if the first metal patch 70 is circular, the metal ring 80 is a circular ring. When the first metal patch 70 is a polygon, the metal ring 80 is correspondingly a polygonal ring. When the first metal patch is cross-shaped, the metal ring 80 is correspondingly cross-shaped. When the metal ring 80 is used, the metal ring 80 and the first metal patch 70 corresponding to the metal ring 80 are disposed at a same layer, and are in coupling connection. The coupling connection is indirect coupling connection. Details are not described herein.

There may be different quantities of metal rings 80. For example, each first metal patch 70 corresponds to one metal ring 80, or only some of the first metal patches correspond to the metal ring 80. During implementation of this application, a limitation on the metal ring 80 should meet the following: On at least one of the plurality of second substrates 12, a metal ring 80 surrounding the first metal patch 70 on the second substrate 12 is disposed; and the metal ring 80 is in coupling connection to the first metal patch 70 corresponding to the metal ring 80, to improve low-frequency matching. In a specific implementation solution, the vertically polarized antenna uses a structure having two metal rings 80. In addition, when the two metal rings 80 are specifically disposed, the two metal rings 80 are respectively disposed on second substrates 12 that are located at two ends of the plurality of stacked second substrates 12. Certainly, the metal ring 80 may alternatively be disposed on another second substrate 12. That is, the two metal rings 80 respectively correspond to the first metal patch 70 located at the top and the first metal patch 70 located at the bottom. Certainly, it should be understood that the foregoing description is merely a specific example. The metal ring 80 provided in this embodiment of this application is not limited to what is shown in the foregoing figure. That is, a quantity of metal rings is not limited, and a disposing position is also not limited. For example, there may be different quantities of metal rings 80, for example, three metal rings 80 or four metal rings 80. Even if there are two metal rings 80, the two metal rings 80 may still correspond to the first metal patches 70 located in the middle part.

Figure 4:
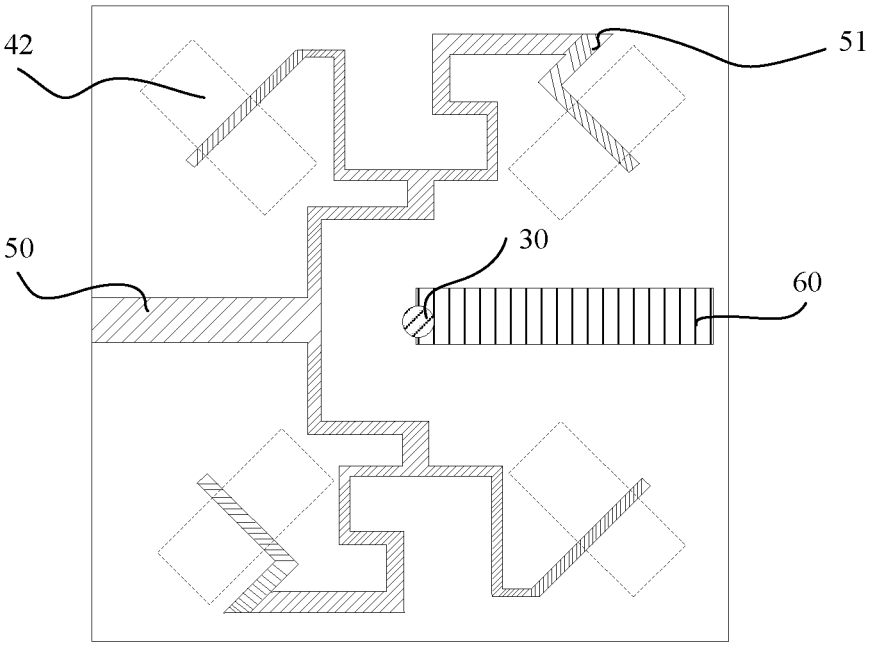
FIG. 4 is a schematic structural diagram of a first feeding unit according to an embodiment of this application.

When feeding is specifically implemented, the vertically polarized antenna is fed by using the disposed second feeding unit 60. The second feeding unit 60 includes a second feeding line. As shown in FIG. 4, the second feeding line and the first feeding line are disposed in a same plane of the first substrate 11. In addition, to feed the second radiating element, the second feeding unit 60 further includes a metalized via 30. The metalized via 30 penetrates the first substrate 11 and the plurality of second substrates 12, and the metalized via 30 is electrically connected to the second feeding line. In addition, when the metalized via 30 is specifically disposed, the metalized via 30 is formed by connecting different holes on the first substrate 11 and the second substrates 12 in series, and the plurality of holes are electrically connected after being connected in series. When the metalized via 30 is connected to the first metal patch 70, the coupling connection is used. In addition, when the foregoing technical solutions are specifically implemented, the metalized via 30 is electrically isolated from the first radiating element 40. As shown in FIG. 5, when the metalized via 30 is connected to the first metal patch 70, the metalized via 30 and the first metal patch 70 have a same axis. During use, a signal of the second feeding line is transmitted to each first metal patch 70 through the metalized via 30.

Figure 8:
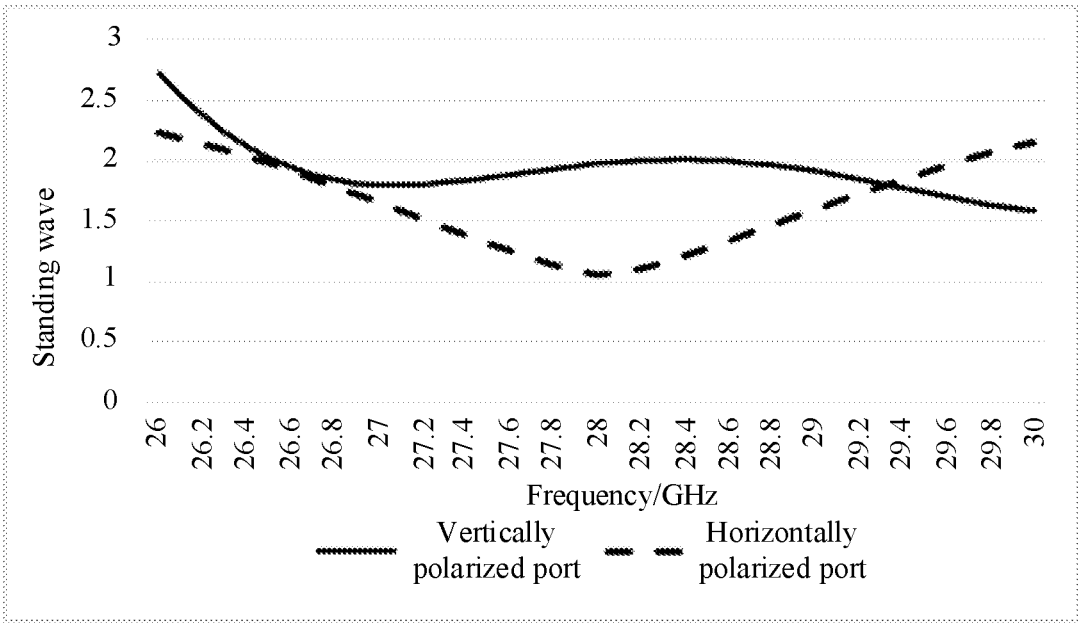
FIG. 8 is a schematic diagram of standing waves, obtained through simulation, at two ports of an omnidirectional dual-polarized antenna shown in FIG. 1.
Figure 9:
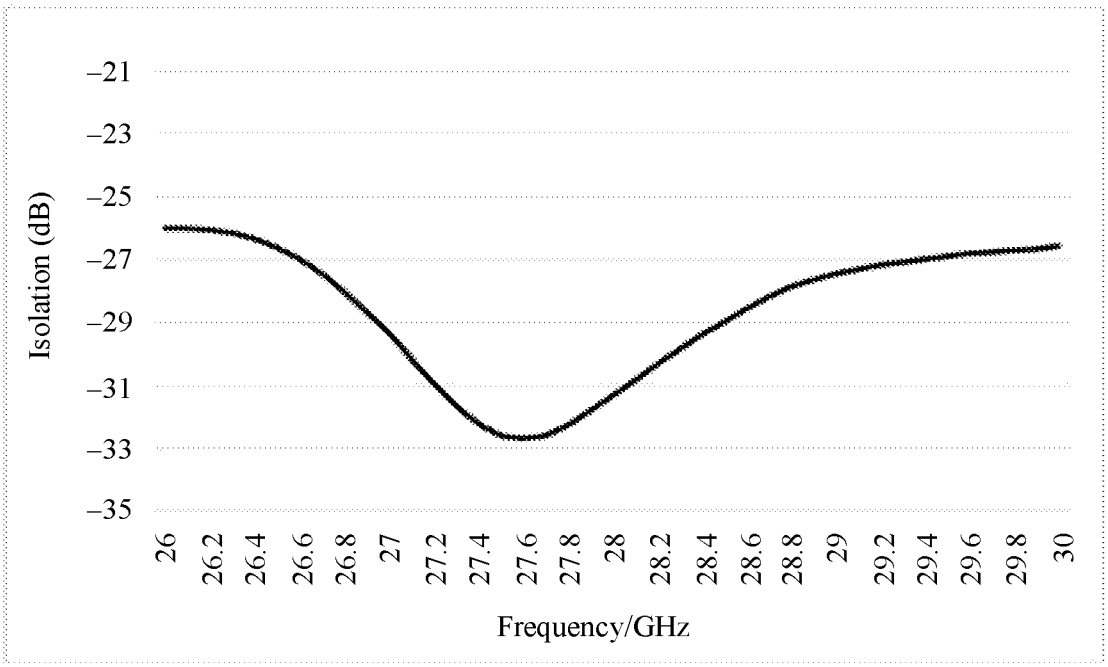
FIG. 9 is a schematic diagram of an isolation, obtained through simulation, between two ports of an omnidirectional dual-polarized antenna shown in FIG. 1.
Figure 10A:
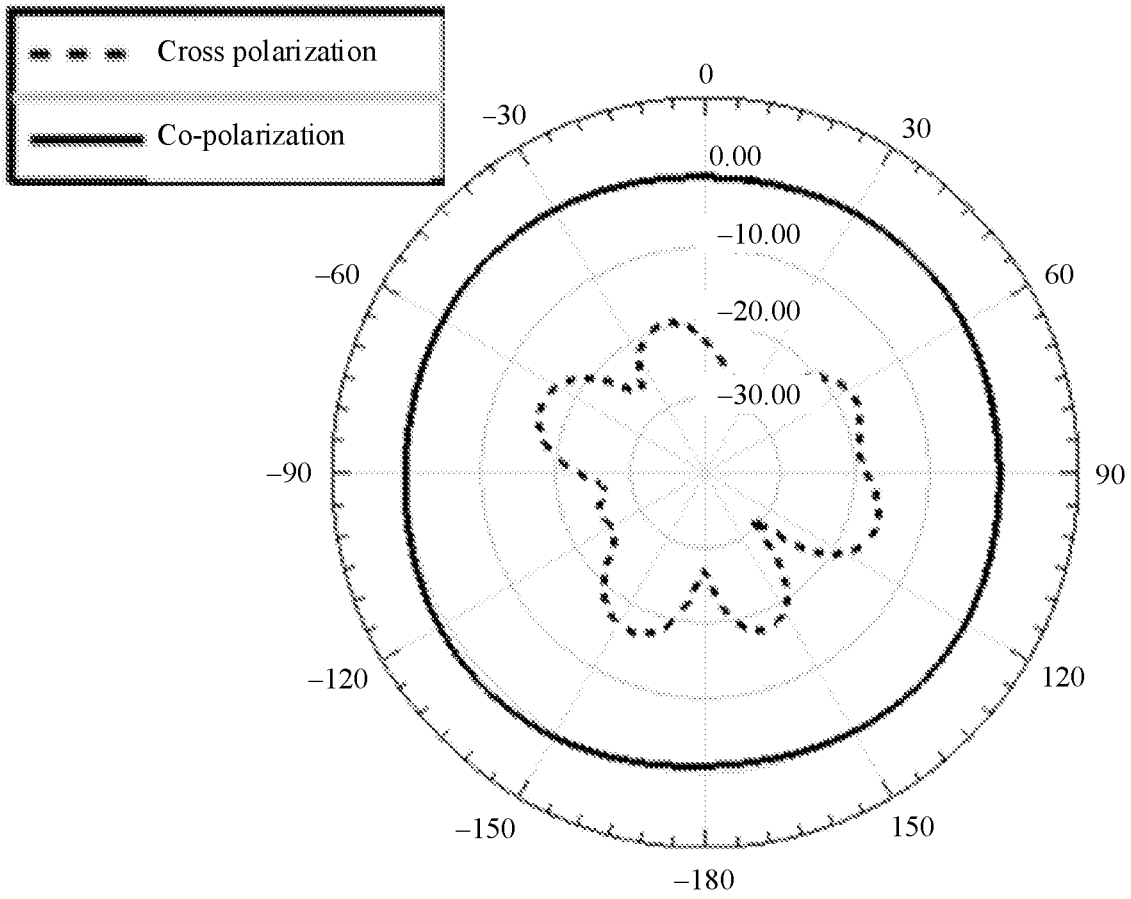
FIG. 10*a* and FIG. 10*b* are direction diagrams of co-polarization and cross polarization, obtained through simulation, in a horizontal plane and a pitch plane when an omnidirectional dual-polarized antenna shown in FIG. 1 is fed through a vertically polarized port.
Figure 10B:
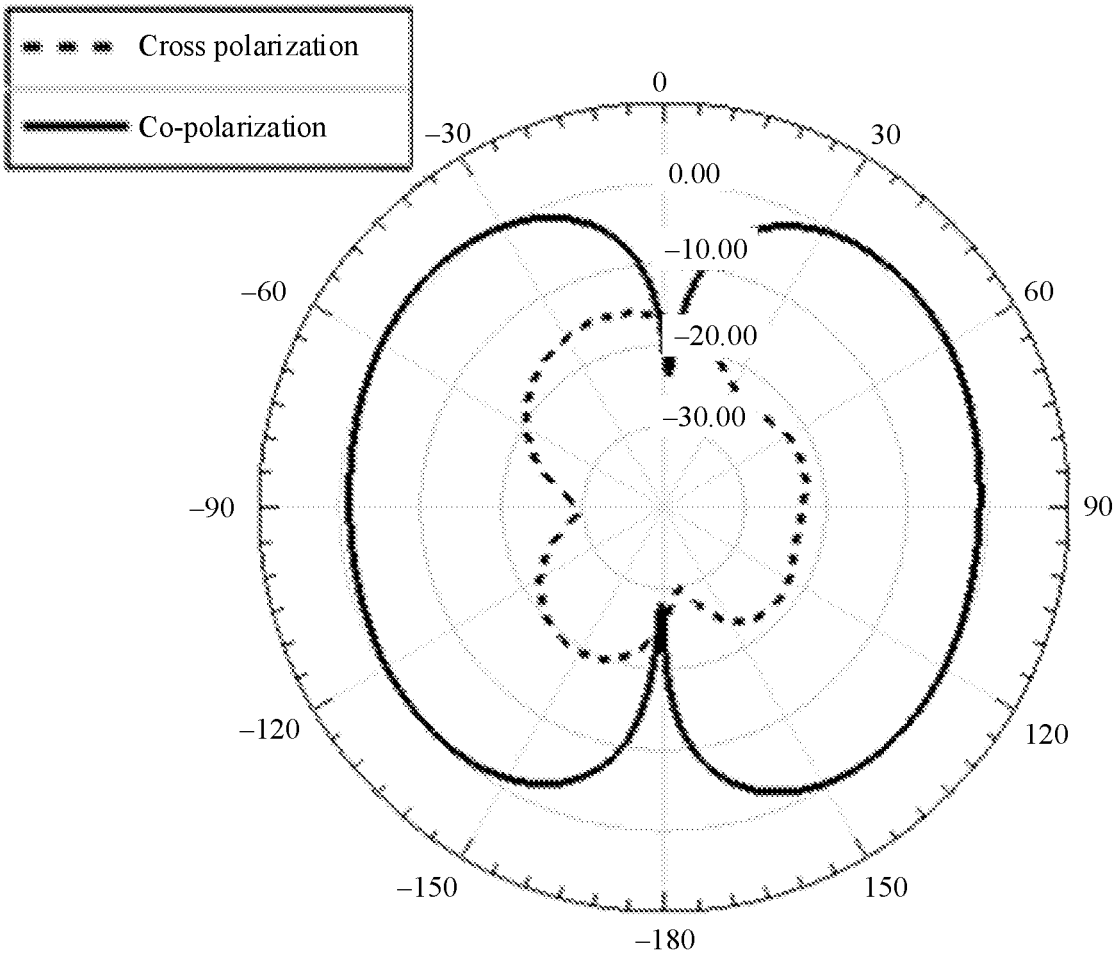
Figure 11A:
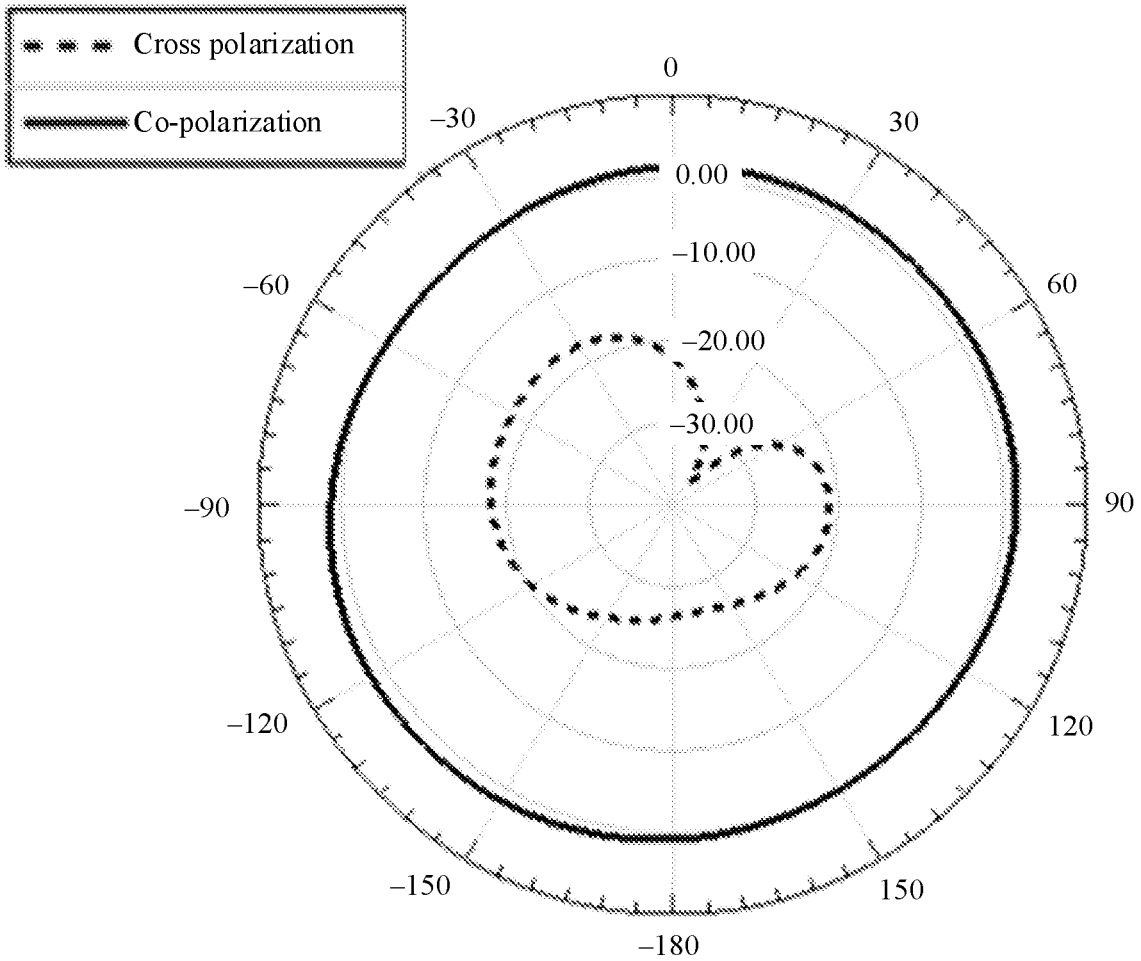
FIG. 11*a* and FIG. 11*b* are direction diagrams of co-polarization and cross polarization, obtained through simulation, in a horizontal plane and a pitch plane when an omnidirectional dual-polarized antenna shown in FIG. 1 is fed through a horizontally polarized port.
Figure 11B:
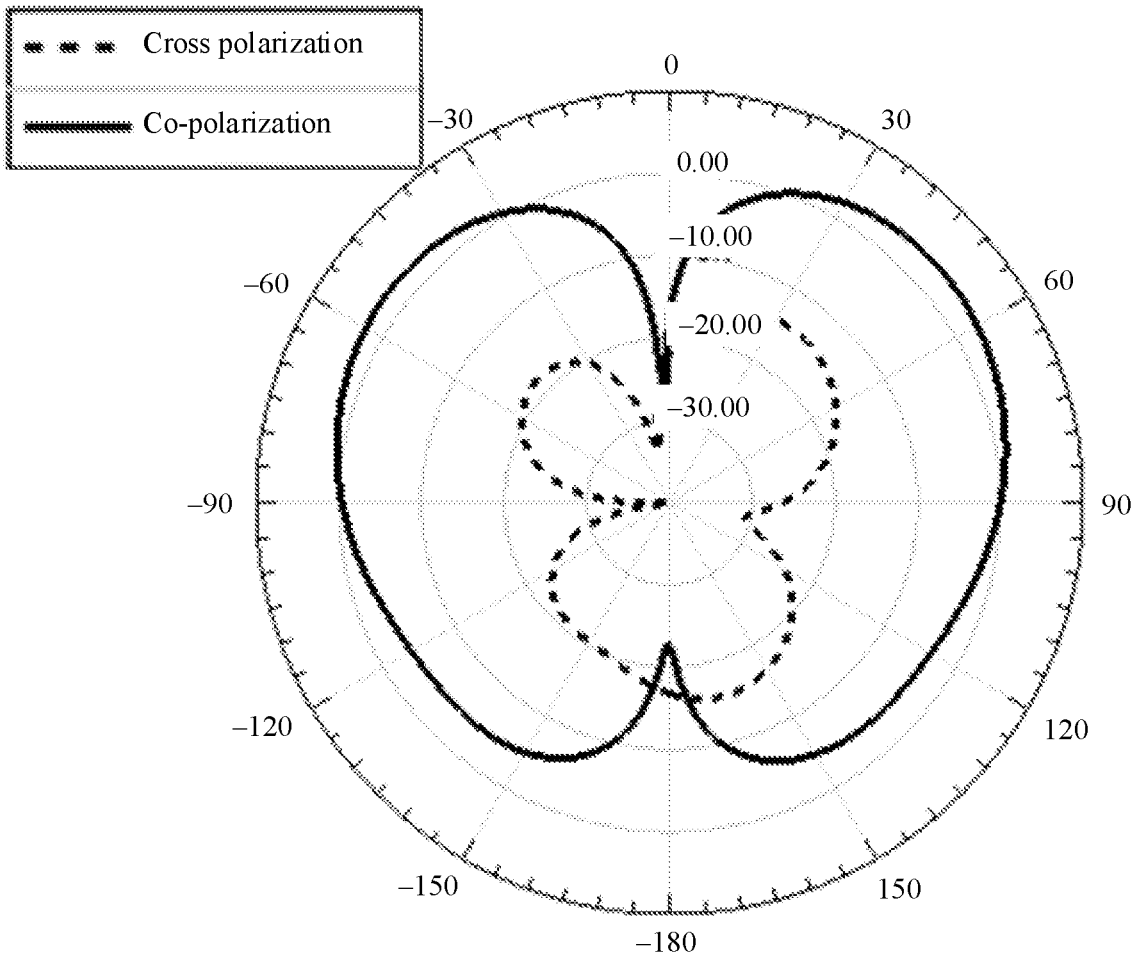

To facilitate understanding of performance of the dual-polarized antenna provided in the embodiments of this application, the dual-polarized antenna shown in FIG. 1 is simulated. A simulation result is shown in FIG. 8. FIG. 8 is a schematic diagram of standing waves, obtained through simulation, at two ports of the omnidirectional dual-polarized antenna shown in FIG. 1. It can be learned from FIG. 8 that in a frequency band of 26.5 GHz to 29.5 GHz, a voltage standing wave ratio of the two ports is less than 2. FIG. 9 is a schematic diagram of an isolation, obtained through simulation, between two ports of the omnidirectional dual-polarized antenna shown in FIG. 1. It can be seen from FIG. 9 that, an in-band isolation of the antenna is greater than 26 dB. In addition, FIG. 10*a* and FIG. 10*b* are direction diagrams of co-polarization and cross polarization, obtained through simulation, in a horizontal plane and a pitch plane when the omnidirectional dual-polarized antenna shown in FIG. 1 is fed through a vertically polarized port. In FIG. 10*a* and FIG. 10*b*, a solid line represents the co-polarization, and a dashed line represents the cross polarization. It can be learned from FIG. 10*a* and FIG. 10*b* that a level value of the cross polarization of the antenna in the horizontal plane is about −15 dB. FIG. 11*a* and FIG. 11*b* are direction diagrams of co-polarization and cross polarization, obtained through simulation, in a horizontal plane when the omnidirectional dual-polarized antenna shown in FIG. 1 is fed through a horizontally polarized port. In FIG. 11*a* and FIG. 11*b*, a solid line represents the co-polarization, and a dashed line represents the cross polarization. A level value of the cross polarization of the antenna in the horizontal plane is about −14 dB.

It can be learned from the foregoing descriptions that, when the base board 10 is used to support the vertically polarized antenna and the horizontally polarized antenna, because radiating elements of both the horizontally polarized antenna and the vertically polarized antenna use metal patches, a relatively small spatial area may be occupied. In addition, the bandwidth of the horizontally polarized antenna and the bandwidth of the vertically polarized antenna are increased by disposing the second metal patches 20 and the metal ring 80.

Figure 14:
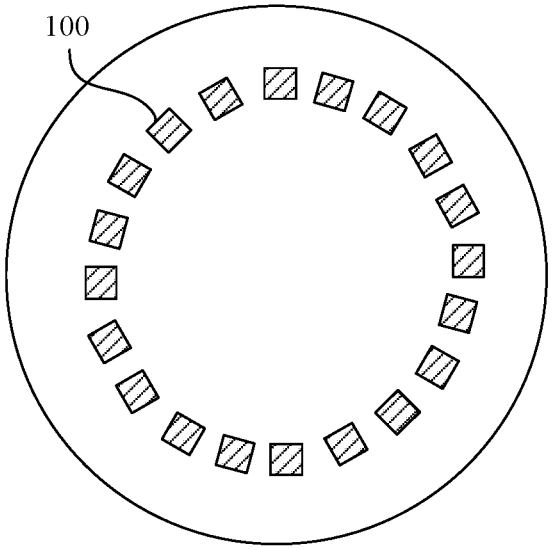
FIG. 14 is a schematic structural diagram of an antenna array according to an embodiment of this application.

In addition, as shown in FIG. 14, an embodiment of this application provides an antenna array. The antenna array includes the dual-polarized antenna according to any one of the foregoing implementation solutions. A base board 10 formed by stacked substrates is used as a support part, so that a horizontally polarized antenna and a vertically polarized antenna are disposed on the base board 10, thereby reducing space occupied by the dual-polarized antenna.

An embodiment of this application further provides a communications device. The communications device includes the dual-polarized antenna according to any one of the implementation solutions or the foregoing antenna array. A base board 10 formed by stacked substrates is used as a support part, so that a horizontally polarized antenna and a vertically polarized antenna are disposed on the base board 10, thereby reducing space occupied by the dual-polarized antenna.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A dual-polarized antenna, comprising: a base board, a horizontally polarized antenna, and a vertically polarized antenna, wherein the base board comprises a first substrate and a plurality of second substrates stacked on the first substrate;

the horizontally polarized antenna comprises a first radiating element disposed on the first substrate; and a first feeding unit that feeds the first radiating element; and the vertically polarized unit comprises a second radiating element and a second feeding unit that feeds the second radiating element, wherein the second radiating element comprises a first metal patch disposed on each second substrate, wherein the second feeding unit comprises a second feeding line disposed on a surface of the first substrate and that is away from the second substrate, and a metalized via that penetrates the first substrate and the plurality of second substrates; and the metalized via is electrically connected to the second feeding line, and the metalized via is coupled to the plurality of first metal patches.

2. The dual-polarized antenna according to claim 1, wherein the first radiating element comprises a metal layer disposed on a surface of the first substrate, and a plurality of slots that are provided on the metal layer and arranged annularly; and the first feeding unit comprises a first feeding line and a power splitter network connected to the first feeding line, and the power splitter network is coupled to each slot.

3. The dual-polarized antenna according to claim 2, wherein the first radiating element is disposed on a surface of the first substrate that faces the second substrate; and the first feeding line is disposed on a surface of the first substrate and that is away from the second substrate.

4. The dual-polarized antenna according to claim 1, further comprising a third substrate, wherein the third substrate and the first substrate are separately arranged on two sides of the plurality of second substrates; a plurality of second metal patches arranged in an array are disposed on a surface of the third substrate and that is away from the second substrate; and the second metal patches are coupled to the first radiating antenna.

5. The dual-polarized antenna according to claim 1, wherein on at least one of the plurality of second substrates, a metal ring surrounding the first metal patch on the second substrate is disposed; and the metal ring is coupled to the first metal patch corresponding to the metal ring.

6. The dual-polarized antenna according to claim 5, wherein there are two metal rings, and the two metal rings are separately disposed on second substrates that are located at two ends of the plurality of stacked second substrates.

7. The dual-polarized antenna according to claim 1, wherein the metalized via and the first metal patch are coaxially disposed.

8. The dual-polarized antenna according to claim 1, wherein the plurality of first metal patches are coaxially disposed.

9. The dual-polarized antenna according to claim 1, wherein the first metal patch is one of circular, polygonal, or cross-shaped.

10. An antenna array, comprising a plurality of dual-polarized antennas, each dual-polarized antenna comprising: a base board, a horizontally polarized antenna, and a vertically polarized antenna, wherein the base board comprises a first substrate and a plurality of second substrates stacked on the first substrate;

the horizontally polarized antenna comprises a first radiating element disposed on the first substrate; and a first feeding unit that feeds the first radiating element; and the vertically polarized unit comprises a second radiating element and a second feeding unit that feeds the second radiating element, wherein the second radiating element comprises a first metal patch disposed on each second substrate, wherein the second feeding unit comprises a second feeding line disposed on a surface of the first substrate and that is away from the second substrate, and a metalized via that penetrates the first substrate and the plurality of second substrates; and the metalized via is electrically connected to the second feeding line, and the metalized via is coupled to the plurality of first metal patches.

11. A communications device, comprising a dual-polarized antenna comprising: a base board, a horizontally polarized antenna, and a vertically polarized antenna, wherein the base board comprises a first substrate and a plurality of second substrates stacked on the first substrate;

the horizontally polarized antenna comprises a first radiating element disposed on the first substrate; and a first feeding unit that feeds the first radiating element; and the vertically polarized unit comprises a second radiating element and a second feeding unit that feeds the second radiating element, wherein the second radiating element comprises a first metal patch disposed on each second substrate, wherein the second feeding unit comprises a second feeding line disposed on a surface of the first substrate and that is away from the second substrate, and a metalized via that penetrates the first substrate and the plurality of second substrates; and the metalized via is electrically connected to the second feeding line, and the metalized via is coupled to the plurality of first metal patches.

* * * * *